US005377427A

United States Patent [19]

Mashata

[11] Patent Number: 5,377,427

[45] Date of Patent: Jan. 3, 1995

[54] HAND-DRYING APPARATUS WITH ROTATING TOWEL SUPPORT

[76] Inventor: Moshe Mashata, 9761 NW. 33 Manor, Sunrise, Fla. 33351

[21] Appl. No.: 98,228

[22] Filed: Jul. 27, 1993

[51] Int. Cl.[6] ..... F26B 19/00

[52] U.S. Cl. ..... 34/275; 34/71; 34/95

[58] Field of Search ..... 34/95, 90, 91, 95.1, 34/95.2, 275, 60, 71, 202

[56] References Cited

U.S. PATENT DOCUMENTS 2,355,221 8/1944 Knight .
2,504,931 4/1950 Knudsen .
2,775,824 1/1957 Weiss .
2,944,278 7/1960 Bullard .
3,012,334 12/1961 Davis ..... 34/95
3,078,591 2/1963 Carpenter .
3,305,938 2/1967 Goldstein .
3,711,958 1/1973 Lepage .
4,250,591 2/1981 Mello .
4,432,112 2/1984 Mullem et al. .

*Primary Examiner*—Henry A. Bennett
*Attorney, Agent, or Firm*—Herbert L. Lerner; Laurence A. Greenberg

[57] ABSTRACT

An automatic hand drying apparatus is disclosed. The apparatus comprises a housing defining an inner space; in one embodiment, at least one arm member is attached to and extends away from said housing; a rotating towel device is supported on the arm member; a drive is disposed in the housing for rotating the rotating towel means. In another embodiment, the rotating towels or rollers are supported on a turntable. The preferred drive means include an electro-motor and a transmission connects the motor with the towel. The apparatus may also include a warm air blower disposed in the housing and the housing has warm air nozzle openings formed therein for directing warm air from the warm air blower towards the rotating towel means.

14 Claims, 4 Drawing Sheets

HAND-DRYING APPARATUS WITH ROTATING TOWEL SUPPORT

BACKGROUND OF THE INVENTION

1. Field of the Invention:

The invention relates to an automatic hand-drying apparatus of the type which is mounted on a wall and which is conventionally used in public restrooms, such as in restaurants.

2. Description of the Related Art:

A hand-drying apparatus of the general kind, namely a combination of warm air blower and contact-type towel dryer, is known from U.S. Pat. No. 3,305,938 to Goldstein. In that device, a paper towel is suspended from a cabinet and streams of warm air are blown past the paper towel.

No rotary drying cylinders have been provided in the art of hand-dryers. And no truly advantageous combination of towel-type dryer and warm air-type dryers has been heretofore proposed.

SUMMARY OF THE INVENTION

It is accordingly an object of the invention to provide a hand-drying apparatus with a rotating towel support, which overcomes the hereinafore-mentioned disadvantages of the heretofore-known devices of this general type and which provides an extremely efficient hand-dryer apparatus which combines the action of a cloth towel with that of a warm air blower apparatus.

With the foregoing and other objects in view there is provided, in accordance with the invention, an automatic hand drying apparatus, comprising:

- a housing defining an inner space;
- an arm member attached to and extending away from the housing;
- rotating towel means supported on the arm member;
- drive means disposed in the housing for rotating the rotating towel means.

In accordance with an added feature of the invention, the drive means include an electro-motor disposed in the inner space and transmission means connecting the electro-motor with the rotating towel means, the transmission means including a gear wheel attached to the rotating towel means and a worm connected between the gear wheel and the electro-motor. An electro-motor is easily controlled in terms of speed and timed operation.

In accordance with another feature of the invention, the automatic hand drying apparatus includes a warm air blower disposed in the inner space, the housing having warm air nozzle openings formed therein for directing warm air from the warm air blower towards the rotating towel means. The warm air fulfills two functions, namely to more efficiently dry the hands and to very quickly dry the towels. In that respect it is noted that the air nozzles (often simple openings formed in the housing wall) may be directed only at towels on the inside of the housing, at the towel being used, or at both general areas.

In accordance with a further feature of the invention, the rotating towel means include a spindle which is rotatably and vertically supported on the arm member and platform means for supporting a cylindrical roller thereon. The platform means provide a frictional support for the rotating towels, i.e. a sliding clutch or slip clutch between the towel and the driven spindle. Should the towel cylinder be stopped by any type of obstacle, the drive will not force the towel, nor will the drive and the gearing be damaged.

In accordance with again another feature of the invention, the cylindrical roller includes an outer peripheral wall and a multiplicity of soft cloth bristles attached to the outer peripheral wall. In a preferred embodiment, the rotating towel means are two rotating towel rollers supported on the arm member.

With the above-noted and other objects of the invention in view, there is also provided an automatic hand drying apparatus, comprising:

- a housing defining an inner space;
- a turntable rotatably supported on the housing and reaching partly into the inner space;
- a warm air source disposed in the inner space;
- a plurality of rotating towel means supported on the turntable;
- drive means disposed in the inner space for rotating the rotating towel means, and transmission means for drivingly connecting the rotating towel means to the drive means.

This alternative embodiment is distinguished with a high degree of efficiency, as a rather large number of rotating towels may be disposed on the turntable. This provides the advantage, that the apparatus does not require as much exchange of soiled towels against fresh ones, and that wet towel members are given enough time to dry while others are being used.

Other features which are considered as characteristic for the invention are set forth in the appended claims.

Although the invention is illustrated and described herein as embodied in a hand-drying apparatus with a rotating towel support, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

Figure 1:
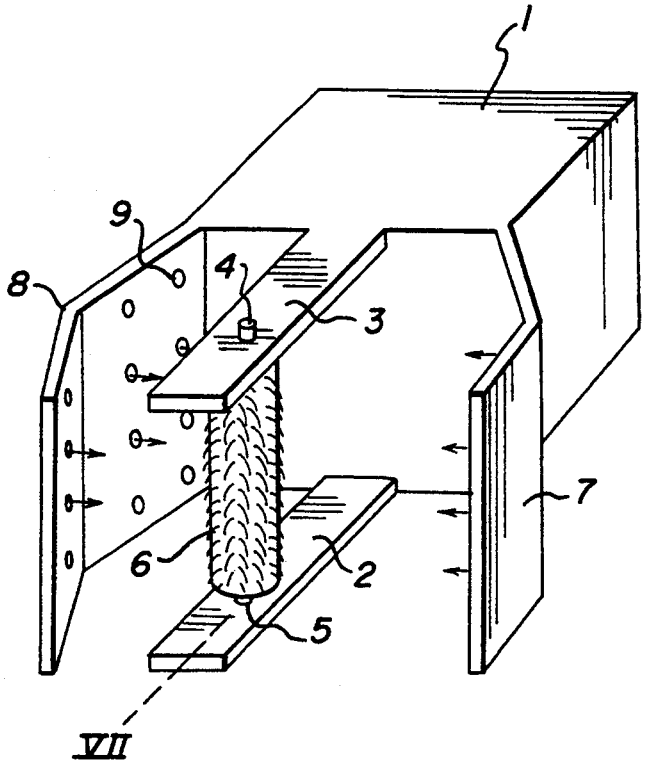
FIG. 1 is a perspective view of a first embodiment of the invention.

DESCRIPTION OF THE PREFERRED EMBODIMENTS:

Referring now to the figures of the drawing in detail and first, particularly, to FIG. 1 thereof, there is seen a housing 1 with a lower extension 2 and an upper extension 3. The extensions 2 and 3 are also referred to as arms 2 and 3. The arms support an axle 4 between them which, in turn, supports a rotating spindle 5. A roller or rotating towel 6 is supported on the rotating spindle 5.

The housing 1 has two lateral extensions 7 and 8 with air vent nozzles 9 formed therein. Air, and preferably hot air, is blown out of the nozzles 9 onto the rotating towel 6. The towel 6 is thereby dried. Additionally, the air stream aids in drying the hands. The apparatus according to the invention is thus seen to be a combination of a towel-type hand dryer and an air blower-type hand dryer.

Figure 2:
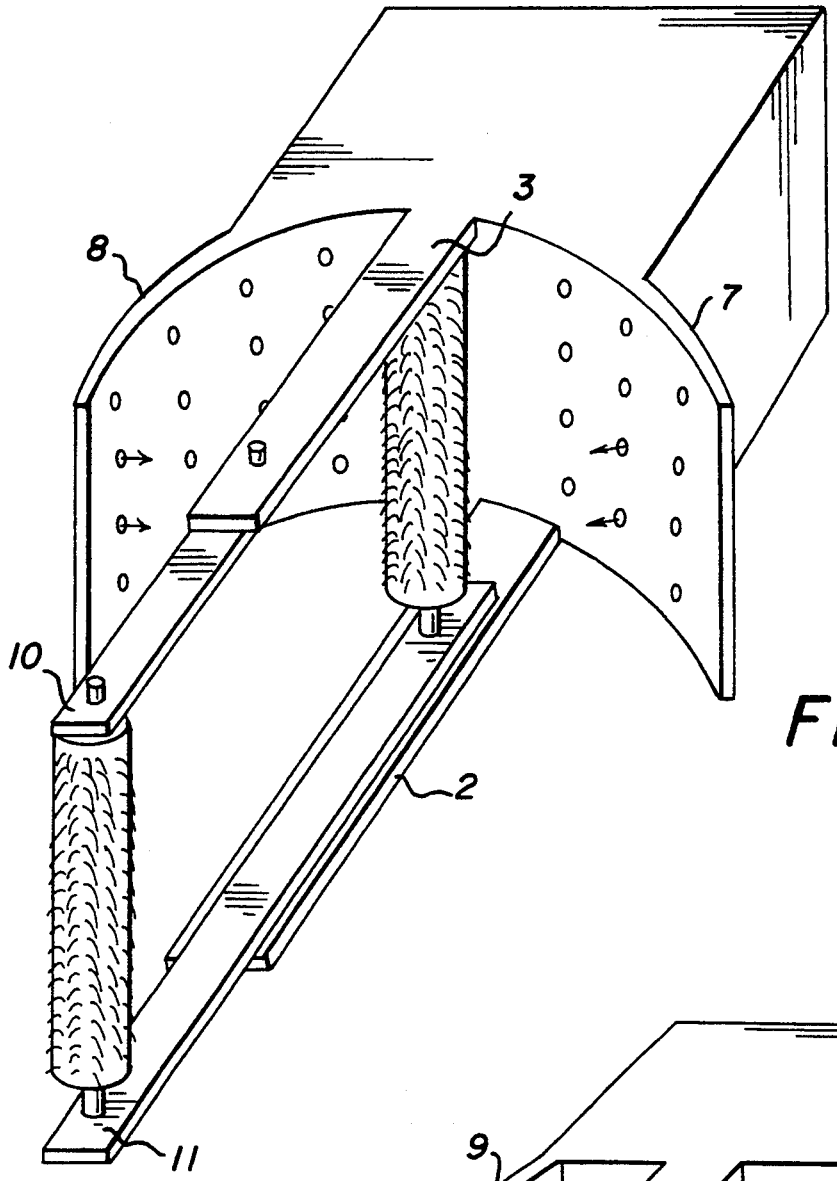
FIG. 2 is a similar view of a second embodiment of the invention.

With reference to FIG. 2, which illustrates a second embodiment of the invention, the extensions 2 and 3 support a rotatable assembly with two rotating towels. The rotatable assembly includes an upper bar 10 and a lower bar 11 between which two rotating towels 6 are supported at opposite ends. It is understood that the number of towels 6 supported on the assembly may be arbitrarily increased.

For the purpose of improving the sanitary conditions of the apparatus, an ultraviolet lamp or a similar device may be provided which acts upon the rotating towel while it is located within the cavity formed between the two lateral extensions 7 and 8.

Figure 3:
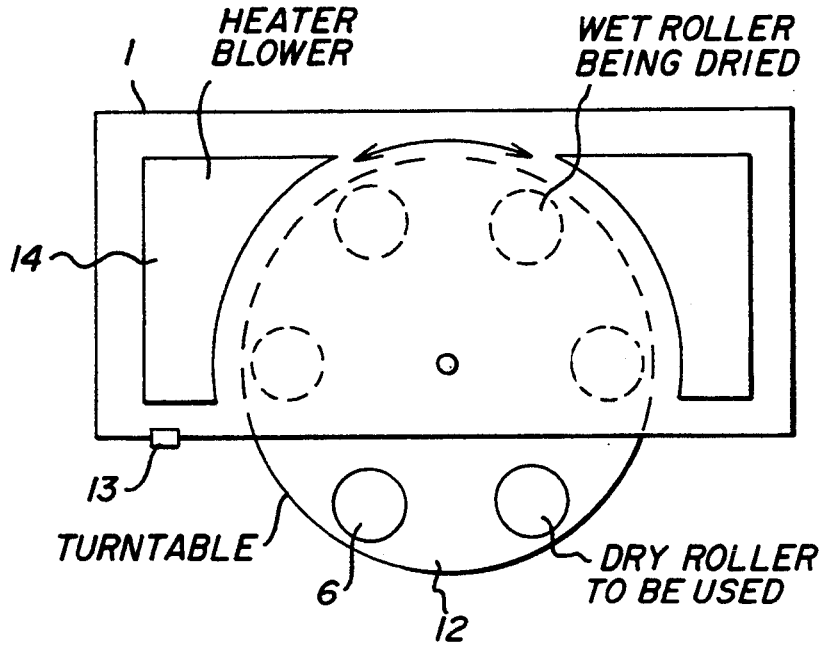
FIG. 3 is a top-plan view of a third embodiment of the invention.

With reference to FIG. 3, which illustrates a third embodiment of the invention, the rotating towels 6 are supported on a turntable 12. The turntable 12 may either be driven or it may simply be freely rotatable, so that the user may index the turntable forward until he or she reaches a fresh towel. In the freely rotatable embodiment, the turntable 12 is provided with non-illustrated indexing notches which provide a certain amount of resistance when the table is turned, giving the user an indication that a prescribed position has been reached. In the automatic feed-type indexing turntable 12, a button 13 may be provided for the user to index the turntable 12 to another position, so as to be able to access a fresh towel.

A heater and blower assembly 14 is disposed within the housing 1. Such heater and blower assemblies are well known in the art and will therefore not be described in detail. In general, the assemblies include a resistance heater element, a fan and electrical/electronic controls for driving the necessary currents.

Figure 4:
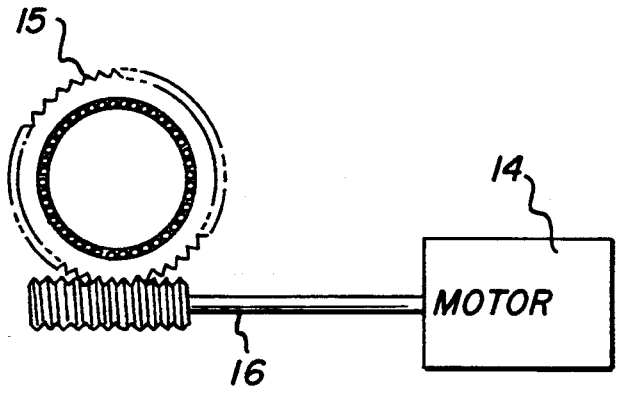
FIG. 4 is a top-plan view of an exemplary worm and gear mechanism for driving a rotating towels.

A motor 14 for driving the rotating towels is disposed inside the housing. The motor is preferably an electromotor and the speed control is set by a non-illustrated electronic control. Several different mechanical connections from the motor to the towel spindle are envisioned. Among the preferred embodiments is an illustrated worm and wheel drive, or non-illustrated bevel gears with a mitre bevel, bevel gears with a spiral bevel, spiral gears or a hypoid gear. Any gearing for non-intersecting and nonparallel axes may be suitably employed. In the embodiment of FIG. 4, a gear 15 is rigidly mounted at the base of the spindle 5 and a worm 16 is directly driven by the motor 14. While a straight worm 16 is shown, it is understood that the worm 16 may be curved, as required by the shape of the device and by the space available for the drive assembly.

Figure 5:
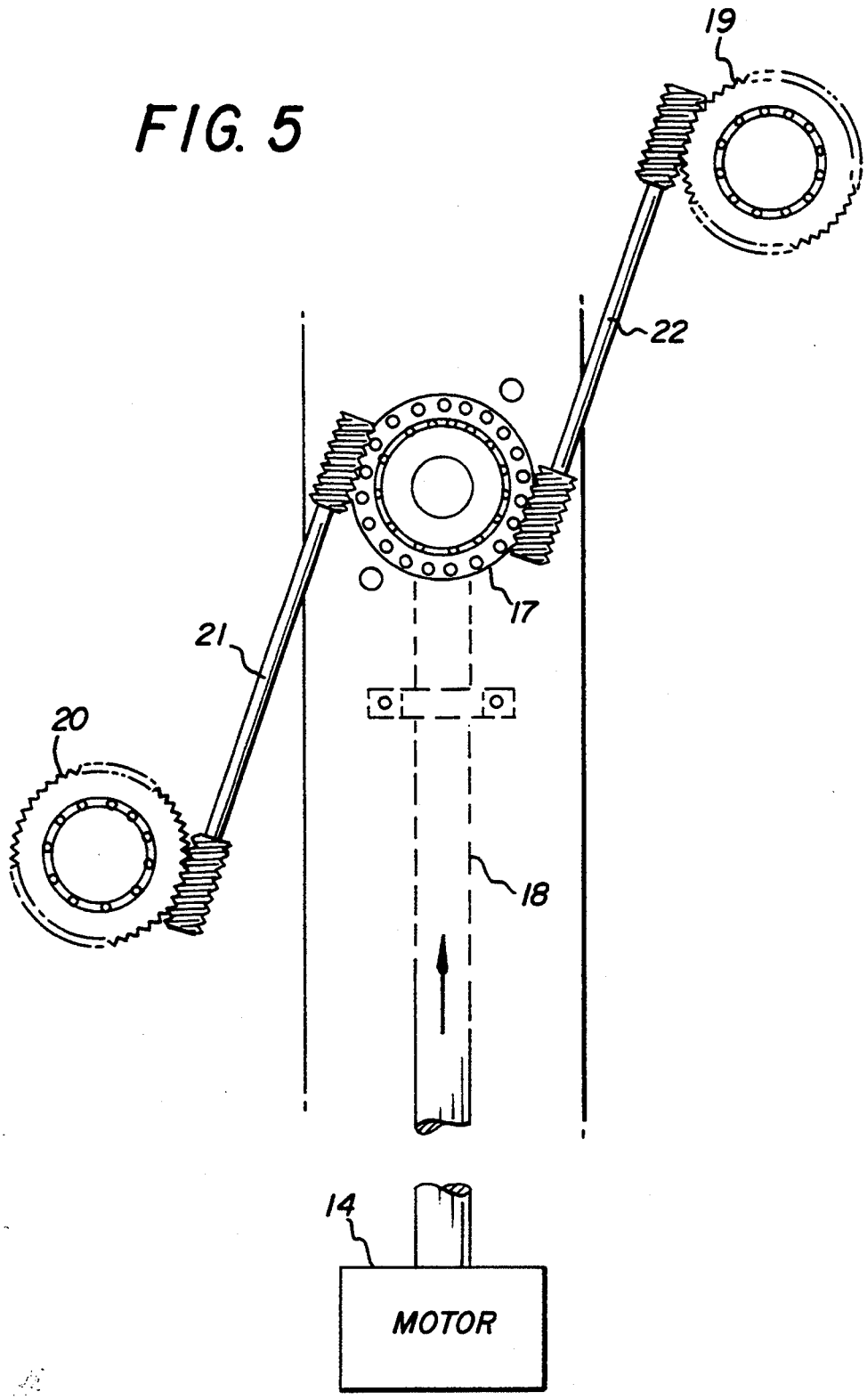
FIG. 5 is a similar view of a similar mechanism.

With reference to FIG. 5, the double worm and gear drive illustrated therein pertains to the embodiment of FIG. 2. A central gear 17 is driven by a worm 18 coming from the motor 4. In this case, the transmission between the worm 18 and the gear 17 is of the type which is suitable for nonparallel but intersecting axes. Satellite gears 19 and 20 are driven by the central gear 17 via worms 21 and 22, respectively. The satellite gears 19 and 20 belong to the towels 6 which are disposed on the rotatable extensions 10 and 11 of FIG. 2. It is seen from FIG. 5 that the extensions 10 and 11 may be rotated on the extensions 2 and 3 without disengaging the satellite gears 19 and 20.

It will be understood that the number of satellite gears may be increased, up to the number required by the third embodiment of FIG. 3 (turntable with six towels).

Figure 6:
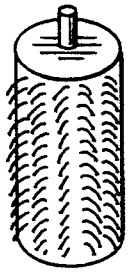
FIG. 6 is a perspective view of a rotating towel.

With reference to FIG. 6, the rotating towel 6 may be formed of a cylinder with soft cloth bristles distributed about the peripheral cylinder surface. The preferred material for the cloth bristles is cotton, a resin fiber-reinforced cotton, or similar materials. In an alternative embodiment, the cylinder may be connected to the warm air source, and may be provided with air nozzles in its jacket surface, so that warm air will support the drying action provided by the cloth bristles. Additionally, such a warm air application will provide for very quick drying of the cloth bristles.

Figure 7:
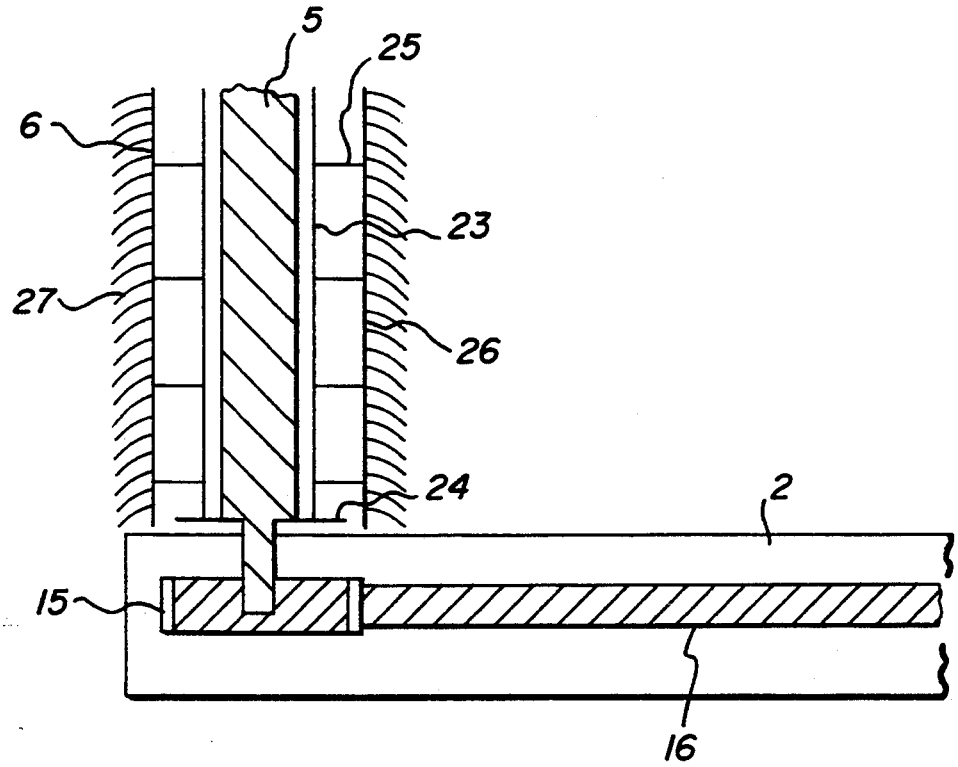
FIG. 7 is a cross-sectional view of a supporting arm with a spindle, the section taken in the direction of line VII in FIG. 1.

With reference to FIG. 7, the spindle 5 is directly connected to the gear 15, which is disposed inside the supporting arm member 2. An inner core 23° of the rotating towel 6 is loosely supported on a platform 24, rigidly connected with the rotating spindle 5. As the core 23 of the towel 6 rests on the platform 24 without any form-locking connection, the towel is forced to rotate with the spindle only by way of the frictional forces between the inner core 23 and the platform 24. This is advantageous in an emergency case when the towel 6 gets stuck, such as when the bristles are caught on a ring or the like. Ribs 25 connect the inner core 23 with a bristle-supporting outer cylinder 26. The cloth bristles are indicated at 27.

It is seen that the exchange of used towels can be effected by simply slipping the core cylinder off the rotating spindle 5. It may be further advantageous to provide the housing with a lid which, when opened, exposes all of the towels in a vertical direction, and all of the towels may be replaced.

I claim:

1. An automatic hand drying apparatus, comprising:
a housing defining an inner space;
an arm member attached to and extending away from said housing;
a rotating towel roller supported on said arm member;
drive means disposed in said housing for rotating said rotating towel means.

2. The automatic hand drying apparatus according to claim 1, wherein the drive means include an electromotor disposed in said inner space and transmission means connecting said electro-motor with said rotating towel roller, said transmission means including a gear wheel attached to said rotating towel roller and a worm connected between said gear wheel and said electromotor.

3. An automatic hand drying apparatus, comprising:
a housing defining an inner space;
an arm member attached to and extending away from said housing;
rotating towel means supported on said arm member;
drive means disposed in said housing for rotating said rotating towel means and a warm air blower disposed in said inner space, said housing having warm air nozzle openings formed therein for directing warm air from said warm air blower towards said rotating towel means.

4. The automatic hand drying apparatus according to claim 1, wherein said rotating towel roller include a spindle rotatably and vertically supported on said arm member and platform means for supporting a cylindrical roller thereon.

5. The automatic hand drying apparatus according to claim 1, wherein said rotating towel roller include a spindle being rotatably and vertically supported on said arm member, a platform rigidly connected to said spindle, and a substantially cylindrical roller inserted over said spindle and supported on said platform.

6. The automatic hand drying apparatus according to claim 5, wherein said cylindrical roller includes an outer peripheral wall and a multiplicity of soft cloth bristles attached to said outer peripheral wall.

7. The automatic hand drying apparatus according to claim 1, wherein said rotating towel roller is in the form of two rotating towel rollers supported on said arm member.

8. An automatic hand drying apparatus, comprising:

a housing defining an inner space;

a turntable rotatably supported on said housing and reaching partly into said inner space;

a warm air source disposed in said inner space;

a plurality of rotating towel means supported on said turntable;

drive means disposed in said inner space for rotating said rotating towel means, and transmission means for drivingly connecting said rotating towel means to said drive means.

9. The automatic hand drying apparatus according to claim 8, wherein said drive means are an electro-motor disposed in said housing and said transmission means include a gear wheel attached to each of said rotating towel means and worms connected between each of said gear wheels and said electro-motor.

10. The automatic hand drying apparatus according to claim 8, wherein said warm air source is an air blower disposed in said inner space, said housing having warm air nozzle openings formed therein for directing warm air from said warm air blower towards said rotating towel means.

11. The automatic hand drying apparatus according to claim 8, including UV light means disposed in said housing for irradiating said towel means with ultraviolet radiation.

12. The automatic hand drying apparatus according to claim 8, wherein said rotating towel means each include a spindle rotatably and vertically supported on said turntable and a platform for supporting a cylindrical roller thereon.

13. The automatic hand drying apparatus according to claim 8, wherein each of said rotating towel means include a spindle rotatably and vertically supported on said turntable, a platform rigidly connected to said spindle, and a substantially cylindrical roller inserted over said spindle and supported on said platform.

14. The automatic hand drying apparatus according to claim 12, wherein said cylindrical roller includes an outer peripheral wall and a multiplicity of soft cloth bristles attached to said outer peripheral wall.

* * * * *